US011688325B2

(12) United States Patent
Han et al.

(10) Patent No.: US 11,688,325 B2
(45) Date of Patent: Jun. 27, 2023

(54) LIQUID CRYSTAL DISPLAY DEVICE TO REDUCE AFTERIMAGE

(71) Applicants: Wuhan BOE Optoelectronics Technology Co., Ltd., Hubei (CN); BOE Technology Group Co., Ltd., Beijing (CN)

(72) Inventors: Jie Han, Beijing (CN); Yuanhui Guo, Beijing (CN); Wei Zhang, Beijing (CN); Xia Shi, Beijing (CN); Yujie Gao, Beijing (CN); Bing Li, Beijing (CN)

(73) Assignees: Wuhan BOE Optoelectronics Technology Co., Ltd., Hubei (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/531,489

(22) Filed: Nov. 19, 2021

(65) Prior Publication Data

US 2022/0270537 A1 Aug. 25, 2022

(30) Foreign Application Priority Data

Feb. 25, 2021 (CN) ..... 202110211780.4

(51) Int. Cl.
*G09G 3/20* (2006.01)
*G09G 3/36* (2006.01)

(52) U.S. Cl.
CPC ..... *G09G 3/2074* (2013.01); *G09G 3/3607* (2013.01); *G09G 2320/0257* (2013.01); *G09G 2360/16* (2013.01)

(58) Field of Classification Search
None
See application file for complete search history.

(56) References Cited

U.S. PATENT DOCUMENTS

| | | | | |
|---|---|---|---|---|
| 2020/0160801 | A1* | 5/2020 | Wang | G09G 3/36 |
| 2020/0312256 | A1* | 10/2020 | Lin | G09G 3/3648 |
| 2021/0043154 | A1* | 2/2021 | Li | G09G 3/3607 |
| 2021/0201841 | A1* | 7/2021 | Shan | G09G 3/2003 |
| 2021/0225302 | A1* | 7/2021 | Huang | G09G 3/3607 |

* cited by examiner

*Primary Examiner* — Benjamin C Lee
*Assistant Examiner* — Emily J Frank
(74) *Attorney, Agent, or Firm* — IPro, PLLC

(57) ABSTRACT

Provided is a method for driving display and display device including: determining a first target grayscale value and a second target grayscale value in a grayscale matrix of an image to be displayed, the first target grayscale value and the second target grayscale value corresponding to the first sub-pixel and the second sub-pixel of one of the plurality of sub-pixel groups respectively; determining a first actual grayscale value and a second actual grayscale value based on the first target grayscale value and the second grayscale value; driving a first sub-pixel and a second sub-pixel based on the first actual grayscale value and the second actual grayscale value, in an $n^{th}$ display phase; driving a second sub-pixel and a first sub-pixel based on the first target grayscale value and the second actual grayscale value, in an $(n+1)^{th}$ display phase.

20 Claims, 5 Drawing Sheets

LIQUID CRYSTAL DISPLAY DEVICE TO REDUCE AFTERIMAGE

CROSS-REFERENCE TO RELATED APPLICATION

This application claims priority to Chinese Patent Application No. 202110211780.4, filed on Feb. 25, 2021 and entitled "METHOD FOR DRIVING DISPLAY AND DISPLAY DEVICE," the disclosure of which is incorporated by reference in its entirety herein.

TECHNICAL FIELD

The present disclosure relates to the field of display technologies, and more particularly, to a method for driving display and a display device.

BACKGROUND

In recent years, high resolution displays have become the mainstream direction for current research.

SUMMARY

The present disclosure provides a method for driving display and a display device A first aspect of the present disclosure provides applied to a display panel, wherein the display panel includes a plurality of pixel units arranged in an array along a row direction and a column direction; the plurality of pixel units include a plurality of sub-pixel groups arranged in the row direction; each of the plurality of sub-pixel groups includes a first sub-pixel and a second sub-pixel; and the first sub-pixel and the second sub-pixel are provided with a same color and arranged in a column direction; and the method for driving display includes:

determining a first target grayscale value and a second target grayscale value in a grayscale matrix of an image to be displayed, the first target grayscale value and the second target grayscale value corresponding to the first sub-pixel and the second sub-pixel of one of the plurality of sub-pixel groups respectively;

determining a first actual grayscale value and a second actual grayscale value based on the first target grayscale value and the second target grayscale value, wherein the first actual grayscale value is greater than the first target grayscale value and the second target grayscale value, the second actual grayscale value is less than the first target grayscale value and the second target grayscale value, and the sum of a luminance value corresponding to the first actual grayscale value and a luminance value corresponding to the second actual grayscale value is equal to the sum of a luminance value corresponding to the first target grayscale value and a luminance value corresponding to the second target grayscale value;

driving a corresponding first sub-pixel based on the first actual grayscale value and driving a corresponding second sub-pixel based on the second actual grayscale value in an $n^{th}$ display phase; and driving a corresponding second sub-pixel based on the first actual grayscale value, and driving a corresponding first sub-pixel based on the second actual grayscale value in an $(n+1)^{th}$ display phase; n being a positive integer.

In an exemplary embodiment of the present disclosure, the determining the first actual grayscale value and the second actual grayscale value based on the first target grayscale value and the second target grayscale value includes:

determining a first target luminance value and a second target luminance value based on the first target grayscale value and the second target grayscale value respectively;

determining a first actual luminance value and a second actual luminance value based on the first target luminance value and the second target luminance value, wherein the sum of the first target luminance value and the second target luminance value is equal to the sum of the first actual luminance value and the second actual luminance value, the first actual luminance value is greater than the first target luminance value and the second target luminance value, and the second actual luminance value is less than the first target luminance value and the second target luminance value; and determining the first actual grayscale value and the second actual grayscale value based on the first actual luminance value and the second actual luminance value respectively.

In one exemplary embodiment of the present disclosure, the determining the first target luminance value and the second target luminance value based on the first target grayscale value and the second target grayscale value respectively, includes:

obtaining a first luminance when the display panel displays a darkest image, and a second luminance when the display panel displays a whitest image, wherein a grayscale value corresponding to the first luminance is a minimum grayscale value of the display panel, and a second grayscale value corresponding to a second luminance is a maximum grayscale value of the display panel; and calculating the first target luminance value and the second target luminance value corresponding to the first target grayscale value and the second target grayscale value respectively, according to the first luminance, the second luminance and a calculation formula corresponding to a target gamma curve; and both the first target grayscale value and the second target grayscale value are greater than the minimum grayscale value and are less than the maximum grayscale value.

In one exemplary embodiment of the present disclosure, the determining the first actual grayscale value and the second actual grayscale value based on the first actual luminance value and the second actual luminance value respectively, includes:

calculating the first actual grayscale value and the second actual grayscale value corresponding to the first actual luminance value and the second actual luminance value respectively, according to the first luminance, the second luminance and the calculation formula corresponding to the target gamma curve; and the first actual grayscale value is less than the maximum grayscale value, and the second actual grayscale value is greater than or equal to the minimum grayscale value.

In an exemplary embodiment of the present disclosure, the calculation formula corresponding to the target gamma curve is:

$$\left(\frac{n}{M}\right)^{2.2} = \frac{I_n - I_0}{I_M - I_0};$$

n denoting a grayscale value, n being an integer, n being greater than or equal to 0 and less than or equal to M, M denoting a maximum grayscale value of the display panel, $I_0$ denoting a first luminance, $I_M$ denoting a second luminance, and $I_n$ denoting a corresponding luminance when the grayscale value is n.

In one exemplary embodiment of the present disclosure, the maximum grayscale value M of the display panel is equal to 255, the first luminance $I_0$ is equal to 0.5 nit, and the second luminance $I_M$ is equal to 735 nit.

In one exemplary embodiment of the present disclosure, the first target grayscale value corresponding to the first sub-pixel is equal to the second target grayscale value corresponding to the second sub-pixel in each of the plurality of sub-pixel groups; in two adjacent sub-pixel groups, first target grayscale values corresponding to two first sub-pixels are equal, and second target grayscale values corresponding to two second sub-pixels are equal.

In another exemplary embodiment of the present disclosure, a first target grayscale value corresponding to the first sub-pixel in each of the plurality of sub-pixel groups is equal to a second target grayscale value corresponding to the second sub-pixel; a first target grayscale value corresponding to two of the first sub-pixels in an adjacent two of the plurality of sub-pixel groups is not equal, and a second target grayscale value corresponding to two of the second sub-pixels is not equal.

In one exemplary embodiment of the present disclosure, the driving methods for each of the plurality of sub-pixel groups are the same; and in the row direction, the first sub-pixel of one of any two adjacent sub-pixel groups and the second sub-pixel of the other one of the any two adjacent sub-pixel groups are located in the same row, and the second sub-pixel of one of any two adjacent sub-pixel groups and the first sub-pixel of the other one of the any two adjacent sub-pixel groups are located in the same row.

In one exemplary embodiment of the present disclosure, the second actual grayscale value in each of the plurality of sub-pixel groups is the minimum grayscale value.

In one exemplary embodiment of the present disclosure, a duration of each display phase is between 5 s and 30 s.

A second aspect of the present disclosure provides a display device, including:

a display panel, including a plurality of pixel units arranged in an array along a row direction and a column direction, wherein the plurality of pixel units include a plurality of sub-pixel groups arranged in the row direction; each of the plurality of sub-pixel groups includes a first sub-pixel and a second sub-pixel, and the first sub-pixel and the second sub-pixel are provided with a same color and arranged in a column direction;

a driver, configured to drive the corresponding sub-pixel group based on the method for driving display in any one of the above.

In an exemplary embodiment of the present disclosure, a sub-pixel including a liquid crystal layer and a driving electrode layer disposed on at least one side of the liquid crystal layer, wherein the driving electrode layer is configured to provide a driving electric field to the liquid crystal layer according to a driving signal provided by the driver, the driving electric field is used to drive a liquid crystal to deflect in the liquid crystal layer, and the liquid crystal in the liquid crystal layer is a negative liquid crystal.

In an exemplary embodiment of the present disclosure, the liquid crystal in the liquid crystal layer is a negative liquid crystal.

Other characteristics and advantages of the present disclosure will become apparent from the following detailed description, or partly learned from the practice of the present disclosure.

It should be understood that both the general description and the following detailed description above are only exemplary and explanatory, and cannot limit the present disclosure.

BRIEF DESCRIPTION OF THE DRAWINGS

The accompanying drawings, which are incorporated in and constitute a part of this specification, illustrate embodiments consistent with the disclosure and explain the principles of the disclosure together with the specification. Apparently, the accompanying drawings in the following description only show some embodiments of the present disclosure, and those of ordinary skilled in the art can still derive other drawings from these accompanying drawings without creative efforts.

DETAILED DESCRIPTION

The technical solutions of the present disclosure are further described in detail below by reference to the embodiments and in conjunction with the accompanying the drawings. Like or similar reference numbers in the specification indicate like or similar parts. The following description of the embodiments of the present disclosure with reference to the accompanying drawings is intended to explain the general idea of the present disclosure, and should not be construed as a limitation to the present disclosure.

In the following detailed description, for purposes of explanation, many specific details are set forth to provide a comprehensive understanding of the embodiments of the present disclosure. However, one or more embodiments can also be implemented without these specific details obviously.

Unless otherwise defined, technical and scientific terms used in this disclosure should be understood by those of ordinary skills in the art to which this disclosure belongs. The "first", "second" and similar words used in the present disclosure do not indicate any order, quantity or importance, but are only used to distinguish different components.

The use of "include" or "have" or the like in the present disclosure means that the element or item appearing before the word covers the elements or items listed after the word and their equivalents, but does not exclude other elements or items.

Figure 1:
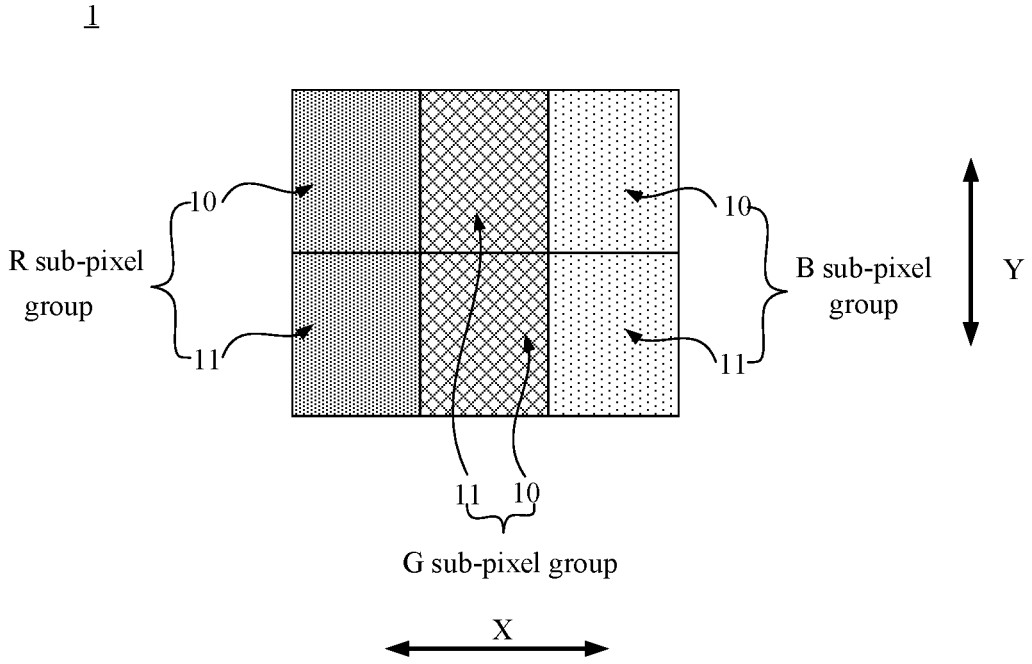
FIG. 1 shows a schematic diagram of a pixel unit in a display panel according to an embodiment of the present disclosure.

One embodiment of the present disclosure provides a display panel, as shown in FIG. 1, which may include a plurality of pixel units 1 arranged in an array along a row direction X and a column direction Y. The pixel unit 1 may include a plurality of sub-pixel groups arranged in the row direction X. Each sub-pixel group includes two sub-pixels with the same color and arranges in the column direction Y, and the two sub-pixels in each sub-pixel group are the first sub-pixel 10 and the second sub-pixel 11 respectively.

For example, as shown in FIG. 1, each pixel unit 1 may include three sub-pixel groups arranged in the row direction X, such as a red (R) sub-pixel group, a green (G) sub-pixel group, and a blue (B) sub-pixel group. It should be understood that the number of sub-pixel groups per pixel unit 1 is not limited to three, and it may also be set to four, and so on, and the sub-pixel group in each pixel unit 1 is not limited to the aforementioned R sub-pixel group, G sub-pixel group, and B sub-pixel group, and it can also be sub-pixel groups of other colors such as yellow.

In an embodiment of the present disclosure, the display panel may be a liquid crystal display panel, and the sub-pixel may include a liquid crystal layer and a driving electrode layer disposed on at least one side of the liquid crystal layer. The driving electrode layer is configured to provide a driving electric field to the liquid crystal layer according to a driving signal provided by the driver, and the driving electric field is used to drive the liquid crystal to deflect in the liquid crystal layer.

It should be noted that the liquid crystal display panel in the embodiments of the present disclosure may be an Advanced Super Dimension Switch (ADS) type, but is not limited to this, and it may also be a Twisted Nematic (TN) type, a Vertical Alignment (VA) type, an In-Plane Switching (IPS) type, a Fringe Field Switching (FFS) type, or the like, as the case may be.

For example, the display panel in the embodiment of the present disclosure may have a resolution of 8K, but is not limited to this, and it may also be 4K, or the like. The display panel in the embodiment of the present disclosure may be applied in a large size display product, such as, a 55-inch, a 65-inch, or a 75-inch television with a resolution of 8K, but is not limited to this, and it may also be applied to a small-size display product, such as a cell phone, tablet computer, and the like.

In order to increase the transmittance of a large size, high resolution display panel, the liquid crystal in the liquid crystal layer of the liquid crystal display panel can be a negative liquid crystal in the embodiments of the present disclosure. Compared with the existing mass-produced HB-type liquid crystal product with a transmittance of 3%, the transmittance of the liquid crystal display panel provided by the embodiment of the present disclosure can be increased by about 6%. That is, when the negative liquid crystal is provided in the liquid crystal display panel of the embodiments of the present disclosure, the transmittance of the liquid crystal display may be about 3.18% (that is, 3%×6%+3%).

But since the negative liquid crystal response time is long, when the TFT-LCD (Thin Film Transistor Liquid Crystal Display) displays the same image for a long time, the liquid crystal cannot be deflected normally under the control of the signal voltage due to long-term driving. Even if the content of the display image is changed, the traces of the previous image can still be seen. This phenomenon is referred to be afterimage. That is, when the negative liquid crystal is provided in the liquid crystal display panel of the embodiment of the present disclosure, the transmittance of the liquid crystal display may be increased, but a more severe afterimage phenomenon is present.

In a related art, a method for driving display for a display panel includes the following steps.

S1. acquiring a grayscale matrix of an image to be displayed, the grayscale included in the grayscale matrix being in one-to-one correspondence with the sub-pixel included in a display panel;

S2. determining a first target grayscale value and a second target grayscale value in the grayscale matrix of an image to be displayed, the first target grayscale value and the second target grayscale value corresponding to the first sub-pixel 10 and the second sub-pixel 11 of one of the plurality of sub-pixel groups respectively; and S3. driving the first sub-pixel 10 and the second sub-pixel 11 based on the first target grayscale value and the second target grayscale value respectively.

Figure 2:
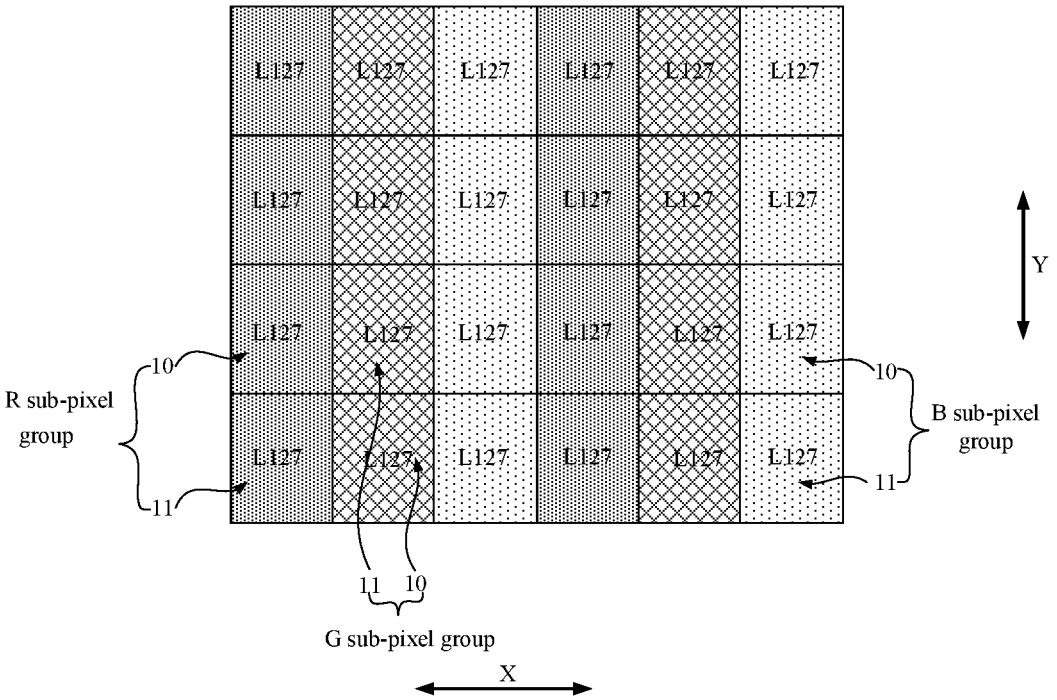
FIG. 2 shows a schematic diagram of a display panel driving each of the sub-pixels based on 127 grayscale value according to an embodiment of the present disclosure.

For example, as shown in FIG. 2, when the first sub-pixel 10 and the second sub-pixel 11 are driven with both the first target grayscale value and the second target grayscale value of 127 (that is, L127), the measured afterimage data may be shown in Table 1. Table 1 shows the relationship among the image display duration, the afterimage level and the disappearing grayscale in the display panel with different numbers (for example, No. 1, No. 2, No. 3, and No. 4 in Table 1). In the following table 1, the afterimage level, the disappearing grayscale, the surface afterimage and the line afterimage are respectively abbreviated as AL, DG, SA and LA. As can be seen from Table 1, the line afterimage level is 3 in most cases, and both the surface afterimage and the line afterimage have the problem of high disappearing grayscales and thus the afterimage problem is more serious. It should be noted that the disappearing grayscale refers to a grayscale when the afterimage is not visible after the checkerboard grid screen is aged and switched to the grayscale.

TABLE 1

| | 3 h (hour) | | | | 24 h (hour) | | | | 72 h (hour) | | | | 168 h (hour) | | | |
|---|---|---|---|---|---|---|---|---|---|---|---|---|---|---|---|---|
| | AL | | DG | | AL | | DG | | AL | | DG | | AL | | DG | |
| | SA | LA | SA | LA | SA | LA | SA | LA | SA | LA | SA | LA | SA | LA | SA | LA |
| No. 1 | 1 | 3 | 190 | 180 | 1 | 3 | 205 | 180 | 1 | 3 | 220 | 180 | 1 | 3 | 220 | 180 |
| No. 2 | 1 | 3 | 195 | 180 | 1 | 3 | 215 | 185 | 1 | 3 | 210 | 180 | 1 | 3 | 190 | 205 |
| No. 3 | 1 | 3 | — | 175 | 0 | 3 | — | 175 | 1 | 3 | 220 | 175 | 1 | 3 | 220 | 175 |
| No. 4 | 1 | 3 | 190 | 180 | 1 | 3 | 205 | 180 | 1 | 3 | 220 | 195 | 1 | 3 | 225 | 185 |

To solve the aforementioned problems, the embodiments of the present disclosure also provide a method for driving display that can be applied to a display panel, which may be but is not limited to this, and it may also be an organic light emitting diode (OLED) display panel, as the case may be.

It should be noted that the structure of the display panel in the embodiments of the present disclosure may be referred to the aforementioned contents, and is not narrated herein. Moreover, it should also be understood that the display panel in the embodiments of the present disclosure may have a plurality of consecutive display phases to display the same image.

Figure 3:
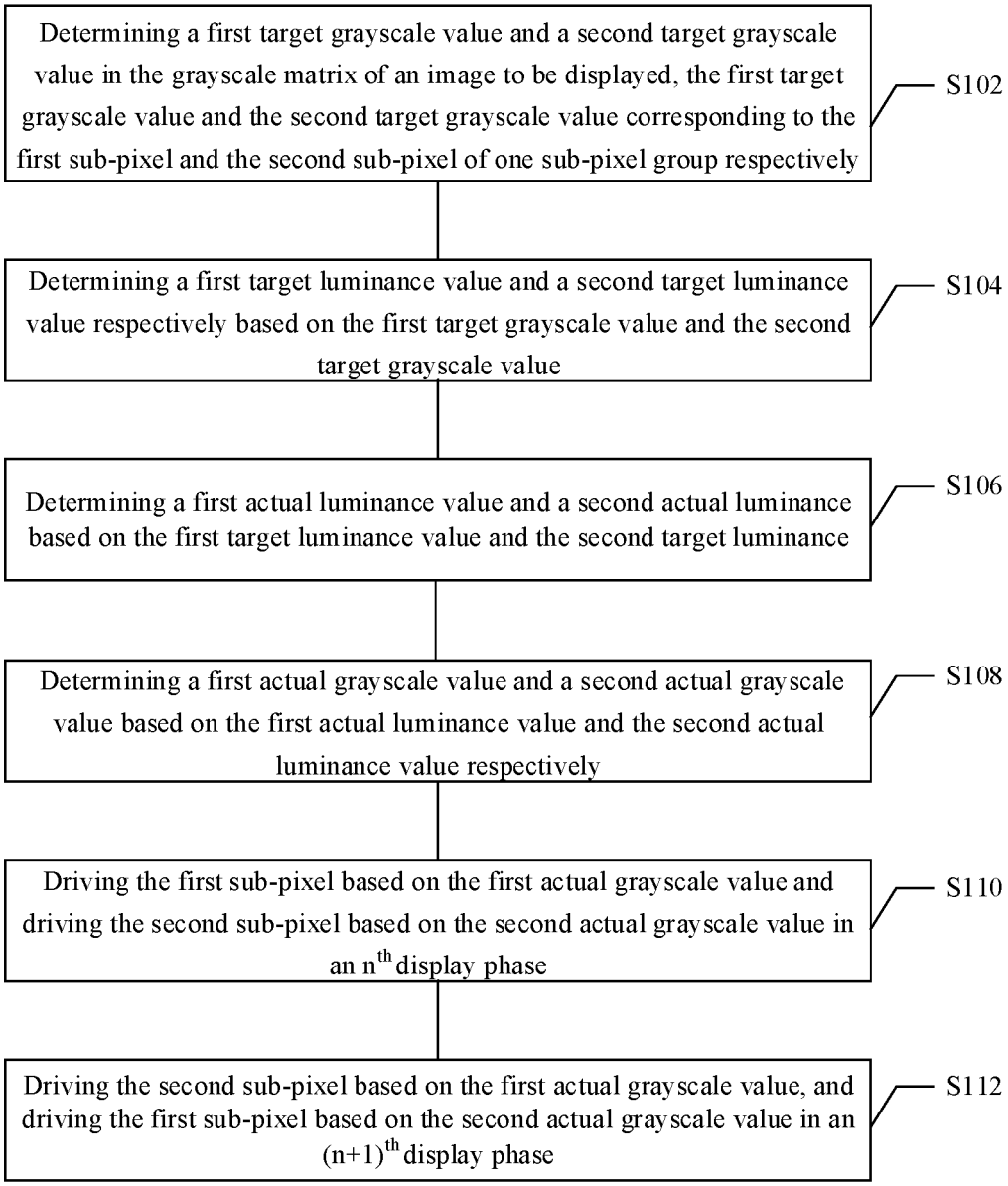
FIG. 3 shows a flowchart of a method for driving display for a display panel according to an embodiment of the present disclosure.

As shown in FIG. 3, the method for driving display of the present disclosure may include driving each sub-pixel group based on acquired grayscale matrix of the image to be displayed, and the method for driving the at least one sub-pixel group includes the following steps.

Figure 4:
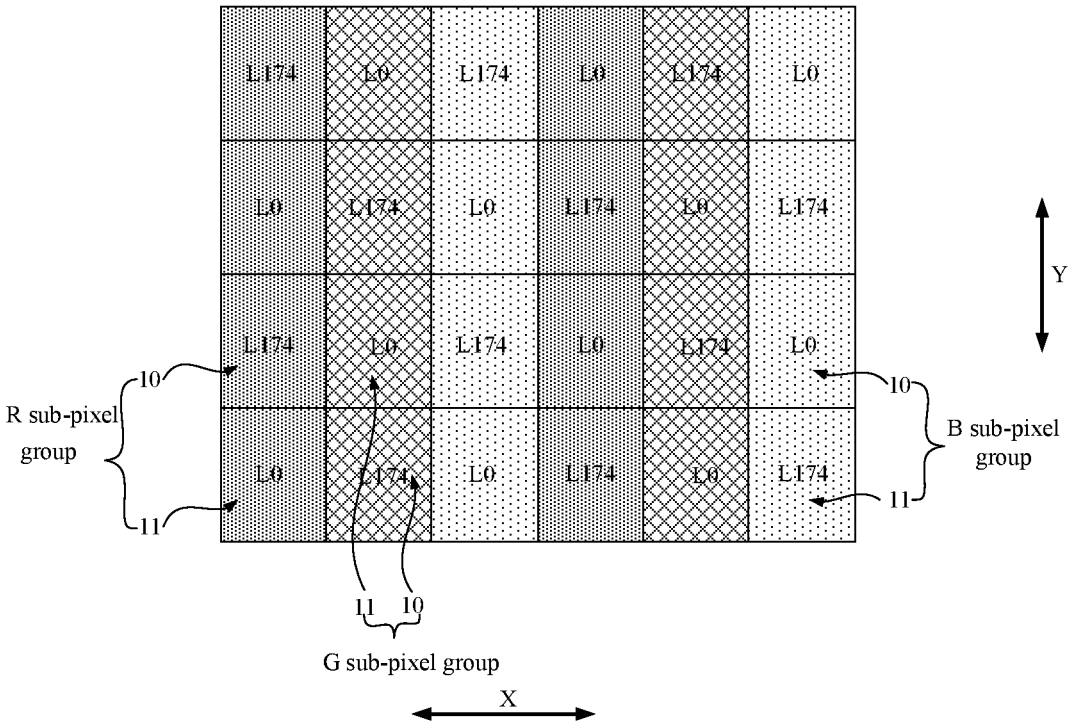
FIG. 4 shows a schematic diagram of the display panel driving a first sub-pixel and a second sub-pixel based on 174 grayscale value and 0 grayscale value respectively, in an $n^{th}$ display phase according to an embodiment of the present disclosure.
Figure 5:
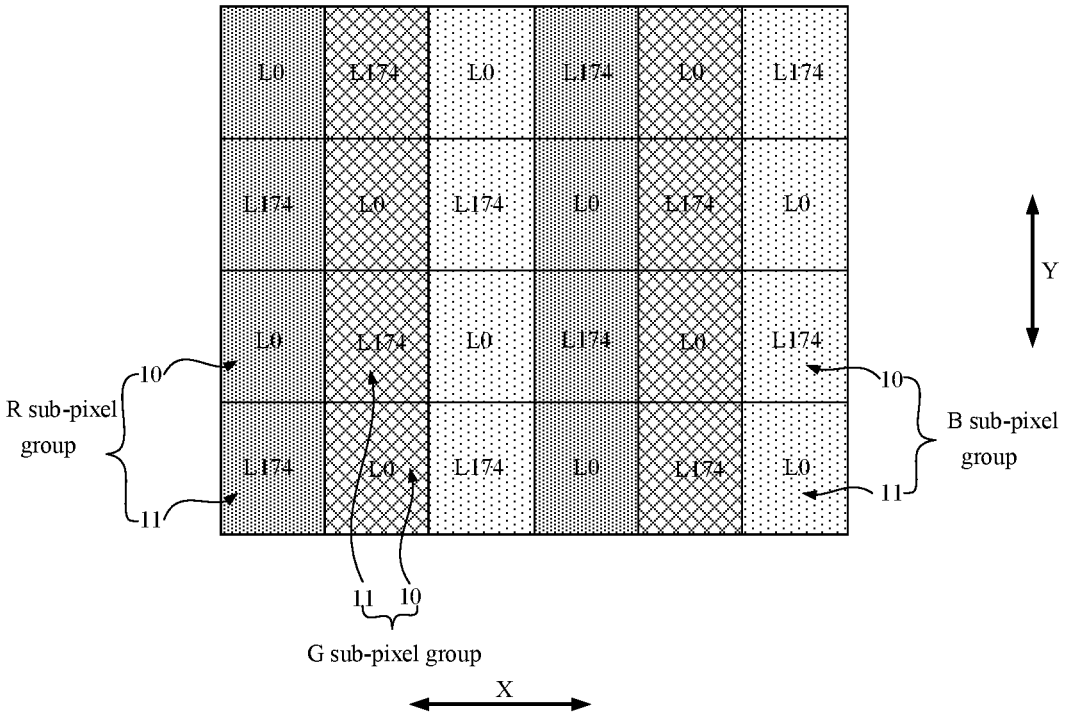
FIG. 5 shows a schematic diagram of the display panel driving the first sub-pixel and the second sub-pixel based on the 0 grayscale value and the 174 grayscale value respectively, in an $(n+1)^{th}$ display phase, according to an embodiment of the present disclosure.

S102. determining a first target grayscale value and a second target grayscale value in the grayscale matrix of an image to be displayed, the first target grayscale value and the second target grayscale value corresponding to the first sub-pixel 10 and the second sub-pixel 11 of one sub-pixel group respectively;

S104. determining a first target luminance value and a second target luminance value respectively, based on the first target grayscale value and the second target grayscale value;

S106. determining a first actual luminance value and a second actual luminance value based on the first target luminance value and the second target luminance value such that the sum of the first target luminance value and the second target luminance value is equal to the sum of the first actual luminance value and the second actual luminance value (that is, the sum of the first target luminance value and the second target luminance value is equal to the target total luminance value, and the sum of the first actual luminance value and the second actual luminance value is equal to the target total luminance value), where the first actual luminance value is greater than the first target luminance value and the second target luminance value, and the second actual luminance value is less than the first target luminance value and the second target luminance value;

S108. determining a first actual grayscale value and a second actual grayscale value based on the first actual luminance value and the second actual luminance value respectively, where the first actual grayscale value is greater than the first target grayscale value and the second target grayscale value, and the second actual grayscale value is less than the first target grayscale value and the second target grayscale value;

S110. driving the corresponding first sub-pixel 10 based on the first actual grayscale value and driving the corresponding second sub-pixel 11 based on the second actual grayscale value in an $n^{th}$ display phase, as shown in FIG. 4; and S112. driving the corresponding second sub-pixel 11 based on the first actual grayscale value, and driving the corresponding first sub-pixel 10 corresponding to the second actual grayscale value in an $(n+1)^{th}$ display phase, as shown in FIG. 5.

It should be noted that the L174 shown in FIGS. 4 and 5 may be understood as the first actual grayscale value, and L0 may be the second actual grayscale value. The first actual grayscale value in the embodiment of the present disclosure is not limited to 174, and the second actual grayscale value is not limited to 0, as the case may be. Furthermore, it should also be understood that the aforementioned n is a positive integer greater than or equal to 1.

It should be noted that the following is achieved through S104, S106 and S108. The first actual grayscale value and the second actual grayscale value are determined based on the first target grayscale value and the second target grayscale value, the first actual grayscale value is greater than the first target grayscale value and the second target grayscale value, and the second actual grayscale value is less than the first target grayscale value and the second target grayscale value. The sum of the luminance corresponding to the first actual grayscale value and the luminance corresponding to the second actual grayscale value is equal to the sum of the luminance corresponding to the first target grayscale value and the luminance corresponding to the second target grayscale value.

Alternatively, in other embodiments, a mapping relationship between a target grayscale value pair and an actual grayscale value pair may also be pre-established. In this mapping relationship, the target grayscale value pair includes a combination of grayscale values that may occur in the sub-pixel group of the display panel, and each target grayscale value pair corresponds to the actual grayscale value pair. The sum of the luminance values corresponding to the target grayscale value pair is equal to the sum of the luminance values corresponding to the actual grayscale value pair. The first actual grayscale value corresponding to the first target grayscale value and the second actual grayscale value corresponding to the second target grayscale value are obtained by looking up the mapping relationship.

In an embodiment of the present disclosure, by employing the method for driving display described above, a sub-pixel of the sub-pixel group is driven at a higher grayscale value (that is, the first actual grayscale value that is greater than the first target grayscale value and the second target grayscale value), and other sub-pixel is driven at a lower grayscale value (that is, the second actual grayscale value that is less than the first target grayscale value and the second target grayscale value). At the same time, the actual grayscale values corresponding to the first sub-pixel 10 and the second sub-pixel 11 in the adjacent display phases are exchanged under the control of the Polarity Inversion Signal (POL), as shown in FIGS. 4 and 5. In this way, it is ensured that each sub-pixel in each sub-pixel group switches back and forth between high and low grayscales, such that when a negative liquid crystal is employed in the display panel, the afterimage phenomenon under high grayscale observation can be improved and thus the afterimage is lighter, and the transmittance can be increased accordingly.

It should be noted that each actual grayscale value may correspond to a driving voltage for driving the sub-pixel. The driving voltages corresponding to the first sub-pixel 10 and the second sub-pixel 11 in the adjacent display phases are exchanged under the control of the polarity inversion signal. It should be understood that the actual correspondence between the grayscale and the driving voltage may be determined based on actual conditions, which is not too much explained in this disclosure. In addition, the grayscale elements of the grayscale matrix of the image to be displayed and the sub-pixels of the display panel are in one-to-one correspondence in the embodiment of the present disclosure.

In an embodiment of the present disclosure, S104 may include the following steps.

S1042. acquiring a first luminance corresponding to the luminance when the display panel displays a darkest image and a second luminance corresponding to the luminance when the display panel displays a whitest image, where a grayscale value corresponding to the first luminance is a minimum grayscale value of the display panel, and a grayscale value corresponding to the second luminance is a maximum grayscale value of the display panel; and S1044. calculating a first target luminance value and a second target luminance value corresponding to the first target grayscale value and the second target grayscale value respectively, according to the first luminance, the second luminance and a calculation formula corresponding to a target gamma curve; and both the first target grayscale value and the second target grayscale value are greater than the minimum grayscale value and are less than the maximum grayscale value. It should be understood that both the first target luminance value and the second target luminance value are greater than the first luminance and are less than the second luminance.

Alternatively, the target gamma curve may be a gamma 2.2 curve, and a calculation formula corresponding to the target gamma curve is:

$$\left(\frac{n}{M}\right)^{2.2} = \frac{I_n - I_0}{I_M - I_0};$$

n denotes a grayscale value, n is an integer greater than or equal to 0 and less than or equal to M, M denotes a maximum grayscale value of the display panel, $I_0$ denotes a first luminance, $I_M$ denotes a second luminance, and $I_n$ denotes a corresponding luminance when the grayscale value is n.

In embodiments of the present disclosure, the display panel may employ 64 grayscales or 256 grayscales to achieve image display. The 64 grayscales represent that there are 64 grayscale values, 0 represents the minimum grayscale value (that is, the grayscale value when the display panel displays the darkest image), and 63 represents the maximum grayscale value (that is, the grayscale value when the display panel displays the whitest image). Thus, when the display panel has 64 grayscales, M is equal to 63. The 256 grayscales represent that there are 256 grayscale values, 0 represents the minimum grayscale value (that is, the grayscale value when the display panel displays the darkest image), and 255 represents the maximum grayscale value (that is, the grayscale value when the display panel displays the whitest image). Thus, when the display panel has 256 grayscales, M is equal to 255.

Taking the display panel of the present disclosure with 256 grayscales as an example for description, the minimum grayscale value of the display panel is equal to 0, and the first luminance $I_0$ corresponding to the minimum grayscale value is equal to 0.5 nit but not limited to this and it may also be equal to 0, as the case may be; and the maximum grayscale value M of the display panel is equal to 255 and the second luminance $I_M$ corresponding to this maximum grayscale value is equal to 735 nit, but not limited to this, and it may be other values, as the case may be.

It should be noted that the luminance corresponding to the minimum and maximum grayscale values of the embodiments of the present disclosure remains unchanged.

In an embodiment of the present disclosure, S108, may include:

calculating the first actual grayscale value and the second actual grayscale value corresponding to the first actual luminance value and the second actual luminance value respectively according to the first luminance, the second luminance and the calculation formula corresponding to the target gamma curve; and the first actual grayscale value is less than the maximum grayscale value, and the second actual grayscale value is greater than or equal to the minimum grayscale value.

It should be understood that the first actual luminance may be less than the second luminance, and the second actual grayscale value may be greater than or equal to the first luminance.

In embodiments of the present disclosure, the first target grayscale value corresponding to the first sub-pixel 10 in each sub-pixel group is equal to the second target grayscale value corresponding to the second sub-pixel 11, for example, both the first target grayscale value and the second target grayscale value may be 127.

In addition, in the adjacent two sub-pixel groups, the first target grayscale values corresponding to the two first sub-pixels 10 are equal and the second target grayscale values corresponding to the two second sub-pixels 11 are equal; or, in the adjacent two sub-pixel groups, the first target grayscale values corresponding to the two first sub-pixels 10 are not equal and the second target grayscale values corresponding to the two second sub-pixels 11 are not equal, depending on the specific to-be-displayed image.

In embodiments of the present disclosure, the driving methods of each sub-pixel group are same, that is, each sub-pixel group may be driven by the aforementioned driving method. In the row direction X, the first sub-pixel 10 of one of any two adjacent sub-pixel groups and the second sub-pixel 11 of the other of the any two adjacent sub-pixel groups are in the same row, and the second sub-pixel 11 of one of the adjacent two sub-pixel groups and the first sub-pixel 10 of the other of the adjacent two sub-pixel groups are in the same row. In this way, in the same display phase, one sub-pixel of two adjacent sub-pixels in the same row corresponds to the first actual grayscale value, and the other sub-pixel corresponds to the second actual grayscale value. In addition, one sub-pixel of the two adjacent sub-pixels in the same column corresponds to the first actual grayscale value, and the other sub-pixel corresponds to the second actual grayscale value. In this way, the horizontal stripes can be avoided during the display process and the product quality can be improved.

For example, the second actual grayscale values in the driving methods for each sub-pixel group are all the minimum grayscale value, that is, are all 0, which may reduce the design difficulty of the method for driving display. It should be noted that when the second actual grayscale values in the driving methods for each sub-pixel group are equal and are all the minimum grayscale value, the corresponding first actual grayscale values in the driving methods for each sub-pixel group may be equal or may be not, depending on the specific to-be-displayed image.

In the embodiments of the present disclosure, the duration of each display phase is set between 5 s and 30 s, such as 5 s, 10 s, 15 s, 20 s, 25 s, 30 s, and so on. Optionally, when the resolution of the display panel of the embodiment of the disclosure is 8K, the duration of each display phase may be around 15 s; and when the resolution of the display panel is 4K, the duration of each display phase may be around 28 s.

It should be noted that the display phase of the embodiments of the present disclosure may include a plurality of display periods. A display period refers to a period for displaying a frame of image. For example, for any one of the display periods, it should include a data write phase and a light emission phase. The duration of the display phase may depend on the actual needs. For example, the duration of the display phase may be set to 15 s, with each display period being 1 s, then each display phase may include 15 display periods. It should be understood that the above description of the display phase is only exemplary, and the duration of the display phase is not limited in this disclosure.

Based on the content mentioned above, each grayscale value element in the grayscale matrix of the obtained image to be displayed being 127 is taken as an example, that is, the first target grayscale value corresponding to the first sub-pixel 10 of each sub-pixel group and the second target grayscale value corresponding to the second sub-pixel 11 being 127 is taken as an example. It can be obtained that a corresponding luminance is 159 nit when the grayscale value is 127 by an actual measurement or according to the calculation formula corresponding to the aforementioned Gamma 2.2 curve. In other words, both the first target luminance value corresponding to the first target grayscale value and the second target luminance value corresponding to the second target grayscale value may be 159 nit, that is, a target total luminance value is 318 (159×2) nit and the target total luminance value is adjusted to the sum of the first actual luminance value and the second actual luminance value. In order to reduce the difficulty of designing the driving method, the second actual luminance value is determined as the luminance value corresponding to the minimum grayscale value, that is, 0.5 nit corresponding to 0 grayscale value, so that the first actual luminance value can be determined to be 317.5 (that is, 159×2−0.5) nit. It can be calculated respectively that the first actual grayscale value is 174 and the second actual grayscale value is 0 by the calculation formula corresponding to the Gamma 2.2 curve. In the $n^{th}$ display phase, the first sub-pixel 10 is driven based on the first actual grayscale value and the second sub-pixel 11 is driven based on the second actual grayscale value; and at the same time, the second sub-pixel 11 is driven based on the first actual grayscale value and the first sub-pixel 10 is driven based on the second actual grayscale value under the control of the POL in the $(n+1)^{th}$ display phase, such that it ensures that each sub-pixel switches back and forth between the high and low grayscales. No afterimage is present when the grayscale value is 0, and the higher the grayscale value, the lighter the subjectively observed afterimage. The afterimage with high grayscale value is not visible, and the afterimage can be improved significantly, so that the transmittance can be improved on the basis of the improvement of the afterimage. It should be noted that the method for driving display has been verified and qualified on 75-inch and 55-inch products with the resolution of 8K, and will is gradually promoted to other 8K products later.

For example, when the value of each grayscale element in the grayscale matrix of the image to be displayed is 63. According to the above driving method, the first actual grayscale value can be 90, and the second actual grayscale value can be 0.

Table 2 shows the relationship among the image display duration, the afterimage level and the disappearing grayscale in the display panel with different numbers (for example, No. 1, No. 2, No. 3, and No. 4 in Table 1) under the driving display method mentioned in the embodiments of the present disclosure. In the following table 2, the afterimage level, the disappearing grayscale, the surface afterimage and the line afterimage are respectively abbreviated as AL, DG, SA and LA. As can be seen from Table 2, the disappearing grayscale is significantly reduced as compared to Table 1.

TABLE 2

| | 3 h (hour) | | | | 24 h (hour) | | | | 72 h (hour) | | | | 168 h (hour) | | | |
|---|---|---|---|---|---|---|---|---|---|---|---|---|---|---|---|---|
| | AL | | DG | | AL | | DG | | AL | | DG | | AL | | DG | |
| | SA | LA | SA | LA | SA | LA | SA | LA | SA | LA | SA | LA | SA | LA | SA | LA |
| No. 1 | 1 | 3 | 150 | 170 | 1 | 3 | 155 | 180 | 1 | 3 | 165 | 180 | 1 | 3 | 170 | 180 |
| No. 2 | 1 | 3 | 145 | 180 | 1 | 3 | 165 | 185 | 1 | 3 | 160 | 180 | 1 | 3 | 180 | 205 |
| No. 3 | 1 | 3 | 155 | 175 | 0 | 3 | 155 | 175 | 1 | 3 | 170 | 175 | 1 | 3 | 175 | 175 |
| No. 4 | 1 | 3 | 150 | 170 | 1 | 3 | 165 | 180 | 1 | 3 | 165 | 195 | 1 | 3 | 170 | 185 |

Embodiments of the present disclosure also provide a display device that includes a display panel and a driver, the structure of which may be described with reference to any of the embodiments previously described, and the driver may be configured to drive the corresponding sub-pixel group based on the method for driving display described in any of the aforementioned embodiments.

In an embodiment of the present disclosure, the driver may include an acquisition circuit configured to acquire a grayscale matrix of an image to be displayed, and a driving circuit configured to drive each sub-pixel group based on the acquired grayscale matrix of the image to be displayed.

As an example, the driving circuit may include a determining unit, a calculating unit, and a driving unit.

The determining unit is configured to determine that the first sub-pixel 10 and the second sub-pixel 11 of the at least one sub-pixel group respectively correspond to the first target grayscale value and the second target grayscale value in the grayscale matrix of the image to be displayed.

The calculating unit is configured to calculate a first target luminance value and a second target luminance value according to the first target luminance value and the second target luminance value respectively; to determine a first actual luminance value and a second actual luminance value according to the first target luminance value and the second target luminance value, wherein the first actual luminance value is greater than the first target luminance value and the second target luminance value, the second actual luminance value is less than the first target luminance value and the second target luminance value, and the sum of the first target luminance value and the second target luminance value is equal to the sum of the first actual luminance value and the second actual luminance value; and to determine a first actual grayscale value and a second actual grayscale value, respectively, based on the first actual luminance value and the second actual luminance value, wherein the first actual grayscale value is greater than the first target grayscale value and the second target grayscale value, the second actual grayscale value is less than the first target grayscale value and the second target grayscale value.

That is, the computing unit is configured to determine a first actual grayscale value and a second actual grayscale value based on the first target grayscale value and the second target grayscale value, where the first actual grayscale value is greater than the first target grayscale value and the second target grayscale value, and the second actual grayscale value is less than the first target grayscale value and the second target grayscale value.

The driving unit is configured to drive the first sub-pixel 10 based on the first actual grayscale value and drive the second sub-pixel 11 based on the second actual grayscale value in the $n^{th}$ display phase; and is further configured to drive the second sub-pixel 11 based on the first actual grayscale value and to drive the first sub-pixel 10 based on the second actual grayscale value in the $(n+1)^{th}$ display phase.

It should be noted that, although the various steps of the method in the present disclosure have been described in the drawings in a particular order, this does not require or imply that these steps must be performed in that particular order, or that all illustrated steps must be performed, to achieve desirable results. Additionally or alternatively, certain steps may be omitted, a plurality of steps may be combined into one step, and/or one step may be broken down into a plurality of steps, and so on, and should be considered as part of the present disclosure.

It should be understood that this disclosure is not intended to limit the application to the details of construction and the arrangement of components set forth in this specification. Other embodiments may be present in the present disclosure, and can be implemented and executed in various ways. Variations and modifications of the foregoing fall within the scope of the present disclosure. It should be understood that the present disclosure disclosed and defined in this specification extends to all alternative combinations of two or more individual features mentioned or obvious in the text and/or drawings. All of these different combinations constitute a number of alternative aspects of the present disclosure. The embodiments of the present specification illustrate the best way known to implement the present disclosure, and will enable those of ordinary skilled in the art to use the present disclosure.

What is claimed is:

1. A method for driving display, applied to a display panel, wherein the display panel comprises a plurality of pixel units arranged in an array along a row direction and a column direction; the plurality of pixel units comprise a plurality of sub-pixel groups arranged in the row direction; each of the plurality of sub-pixel groups comprises a first sub-pixel and a second sub-pixel; and the first sub-pixel and the second sub-pixel are provided with a same color and arranged in a column direction; and the method for driving display comprises:

determining a first target grayscale value and a second target grayscale value in a grayscale matrix of an image to be displayed, wherein the first target grayscale value and the second target grayscale value correspond to the first sub-pixel and the second sub-pixel of one of the plurality of sub-pixel groups respectively;

determining a first actual grayscale value and a second actual grayscale value based on the first target grayscale value and the second target grayscale value, wherein the first actual grayscale value is greater than the first target grayscale value and the second target grayscale value, the second actual grayscale value is less than the first target grayscale value and the second target grayscale value, and the sum of a luminance value corresponding to the first actual grayscale value and a luminance value corresponding to the second actual grayscale value is equal to the sum of a luminance value corresponding to the first target grayscale value and a luminance value corresponding to the second target grayscale value;

driving a corresponding first sub-pixel based on the first actual grayscale value and driving a corresponding second sub-pixel based on the second actual grayscale value in an $n^{th}$ display phase; and driving a corresponding second sub-pixel based on the first actual grayscale value, and driving a corresponding first sub-pixel based on the second actual grayscale value in an $(n+1)^{th}$ display phase; and wherein n is a positive integer.

2. The method for driving display according to claim 1, wherein the determining the first actual grayscale value and the second actual grayscale value based on the first target grayscale value and the second target grayscale value comprises:

determining a first target luminance value and a second target luminance value based on the first target grayscale value and the second target grayscale value respectively;

determining a first actual luminance value and a second actual luminance value based on the first target luminance value and the second target luminance value, wherein the sum of the first target luminance value and the second target luminance value is equal to the sum of the first actual luminance value and the second actual luminance value, the first actual luminance value is greater than the first target luminance value and the second target luminance value, and the second actual luminance value is less than the first target luminance value and the second target luminance value; and determining the first actual grayscale value and the second actual grayscale value based on the first actual luminance value and the second actual luminance value respectively.

3. The method for driving display according to claim 2, wherein the determining the first target luminance value and the second target luminance value based on the first target grayscale value and the second target grayscale value respectively, comprises:

obtaining a first luminance when the display panel displays a darkest image and a second luminance when the display panel displays a whitest image, wherein a grayscale value corresponding to the first luminance is a minimum grayscale value of the display panel, and a second grayscale value corresponding to the second luminance is a maximum grayscale value of the display panel; and calculating the first target luminance value and the second target luminance value corresponding to the first target grayscale value and the second target grayscale value respectively, according to the first luminance, the second luminance and a calculation formula corresponding to a target gamma curve; and wherein both the first target grayscale value and the second target grayscale value are greater than the minimum grayscale value and are less than the maximum grayscale value.

4. The method for driving display according to claim 3, wherein the determining the first actual grayscale value and the second actual grayscale value based on the first actual luminance value and the second actual luminance value respectively comprises:

calculating the first actual grayscale value and the second actual grayscale value corresponding to the first actual luminance value and the second actual luminance value respectively, according to the first luminance, the second luminance and the calculation formula corresponding to the target gamma curve; and wherein the first actual grayscale value is less than the maximum grayscale value, and the second actual grayscale value is greater than or equal to the minimum grayscale value.

5. The method for driving display according to claim 3, wherein the calculation formula corresponding to the target gamma curve is:

$$\left(\frac{n}{M}\right)^{2.2} = \frac{I_n - I_0}{I_M - I_0};$$

n denoting a grayscale value, n being an integer, n being greater than or equal to 0 and less than or equal to M, M denoting a maximum grayscale value of the display panel, $I_0$ denoting a first luminance, $I_M$ denoting a second luminance, and $I_n$ denoting a corresponding luminance when the grayscale value is n.

6. The method for driving display according to claim 5, wherein a maximum grayscale value M of the display panel is equal to 255, the first luminance $I_0$ is equal to 0.5 nit, and the second luminance $I_M$ is equal to 735 nit.

7. The method for driving display according to claim 3, wherein the first target grayscale value corresponding to the first sub-pixel is equal to the second target grayscale value corresponding to the second sub-pixel in each of the plurality of sub-pixel groups; and in two adjacent sub-pixel groups, the first target grayscale values corresponding to the two first sub-pixels are not equal, and the second target grayscale values corresponding to the two second sub-pixels being not equal.

8. The method for driving display according to claim 7, wherein driving methods for each of the plurality of sub-pixel groups are the same; and in the row direction, the first sub-pixel of one of any two adjacent sub-pixel groups and the second sub-pixel of the other one of the any two adjacent sub-pixel groups are located in the same row, and the second sub-pixel of one of any two adjacent sub-pixel groups and the first sub-pixel of the other one of the any two adjacent sub-pixel groups are located in the same row.

9. The method for driving display according to claim 8, wherein the second actual grayscale value in each of the plurality of sub-pixel groups is the minimum grayscale value.

10. The method for driving display according to claim 1, wherein a duration of each display phase is between 5s and 30s.

11. A display device comprising:

a display panel, wherein the display panel comprises a plurality of pixel units arranged in an array along a row direction and a column direction, the plurality of pixel units comprise a plurality of sub-pixel groups arranged in the row direction; each of the plurality of sub-pixel groups comprises a first sub-pixel and a second sub-pixel, and the first sub-pixel and the second sub-pixel are provided with a same color and arranged in a column direction; and a driver, configured to:

determine a first target grayscale value and a second target grayscale value in a grayscale matrix of an image to be displayed, wherein the first target grayscale value and the second target grayscale value correspond to the first sub-pixel and the second sub-pixel of one of the plurality of sub-pixel groups respectively;

determine a first actual grayscale value and a second actual grayscale value based on the first target grayscale value and the second grayscale value, wherein the first actual grayscale value is greater than the first target grayscale value and the second target grayscale value, the second actual grayscale value is less than the first target grayscale value and the second target grayscale value, and the sum of a luminance value corresponding to the first actual grayscale value and a luminance value corresponding to the second actual grayscale value is equal to the sum of a luminance value corresponding to the first target grayscale value and a luminance value corresponding to the second target grayscale value;

drive a corresponding first sub-pixel based on the first actual grayscale value and drive a corresponding second sub-pixel based on the second actual grayscale value in an nth display phase; and drive a corresponding second sub-pixel based on the first actual grayscale value, and drive a corresponding first sub-pixel based on the second actual grayscale value in an (n+1) th display phase; and wherein n is a positive integer.

12. The display device according to claim 11, wherein the sub-pixel comprises a liquid crystal layer and a driving electrode layer disposed on at least one side of the liquid crystal layer, the driving electrode layer is configured to provide a driving electric field to the liquid crystal layer according to a driving signal provided by the driver, the driving electric field is configured to drive a liquid crystal to deflect in the liquid crystal layer, and the liquid crystal in the liquid crystal layer is a negative liquid crystal.

13. The display device according to claim 12, wherein the driver is configured to:

determine a first target luminance value and a second target luminance value based on a first target grayscale value and a second target grayscale value respectively;

determine a first actual luminance value and a second actual luminance value based on the first target luminance value and the second target luminance value, wherein the sum of the first target luminance value and the second target luminance value is equal to the sum of the first actual luminance value and the second actual luminance value, the first actual luminance value is greater than the first target luminance value and the second target luminance value, and the second actual luminance value is less than the first target luminance value and the second target luminance value; and determine the first actual grayscale value and the second actual grayscale value based on the first actual luminance value and the second actual luminance value respectively.

14. The display device according to claim 13, wherein the driver is configured to:

obtain a first luminance when the display panel displays a darkest image and a second luminance when a display panel displays a whitest image, wherein a grayscale value corresponding to the first luminance is a minimum grayscale value of the display panel, and a second grayscale value corresponding to the second luminance is a maximum grayscale value of the display panel; and calculate the first target luminance value and the second target luminance value corresponding to the first target grayscale value and the second target grayscale value respectively, according to the first luminance, the second luminance and a calculation formula corresponding to a target gamma curve; and wherein both the first target grayscale value and the second target grayscale value are greater than the minimum grayscale value and are less than the maximum grayscale value.

15. The display device according to claim 14, wherein the driver is configured to:

calculate a first actual grayscale value and a second actual grayscale value corresponding to the first actual luminance value and the second actual luminance value respectively, according to the first luminance, the second luminance and a calculation formula corresponding to the target gamma curve; and wherein the first actual grayscale value is less than the maximum grayscale value, and the second actual grayscale value is greater than or equal to the minimum grayscale value.

16. The display device according to claim 14, wherein the calculation formula corresponding to the target gamma curve is:

$$\left(\frac{n}{M}\right)^{2.2} = \frac{I_n - I_0}{I_M - I_0};$$

n denoting a grayscale value, n being an integer, n being greater than or equal to 0 and less than or equal to M, M denoting a maximum grayscale value of the display panel, $I_0$ denoting a first luminance, $I_M$ denoting a second luminance, and $I_n$ denoting a corresponding luminance when the grayscale value is n.

17. The display device according to claim 16, wherein a maximum grayscale value M of the display panel is equal to 255, the first luminance $I_0$ is equal to 0.5 nit, and the second luminance $I_M$ is equal to 735 nit.

18. The display device according to claim 14, wherein the first target grayscale value corresponding to the first sub-pixel is equal to the second target grayscale value corresponding to the second sub-pixel in each of the plurality of sub-pixel groups, in two adjacent sub-pixel groups, the first target grayscale values corresponding to the two first sub-pixels are not equal, and the second target grayscale values corresponding to the two second sub-pixels are not equal.

19. The display device according to claim 18, wherein the driving methods for each of the plurality of sub-pixel groups are the same; and in the row direction, the first sub-pixel of one of any two adjacent sub-pixel groups and the second sub-pixel of the other one of the any two adjacent sub-pixel groups are located in the same row, and the second sub-pixel of one of the any two adjacent sub-pixel groups and the first sub-pixel of the other one of the any two adjacent sub-pixel groups are located in the same row.

20. The display device according to claim 19, wherein the second actual grayscale value in each of the plurality of sub-pixel groups is the minimum grayscale value.

* * * * *